US010393050B2

(12) United States Patent
Nagappa et al.

(10) Patent No.: US 10,393,050 B2
(45) Date of Patent: Aug. 27, 2019

(54) ESTIMATION OF CYLINDER CONDITIONS USING A KNOCK SENSOR

(71) Applicant: AI ALPINE US BIDCO INC., Wilmington, DE (US)

(72) Inventors: Sharad Nagappa, Bangalore (IN); Rahul Srinivas Prabhu, Bangalore (IN); Adam Edgar Klingbeil, Niskayuna, NY (US); Prashanth D'Souza, Bangalore (IN)

(73) Assignee: AI ALPINE US BIDCO INC., Wilmington, DE (US)

( * ) Notice: Subject to any disclaimer, the term of this patent is extended or adjusted under 35 U.S.C. 154(b) by 0 days.

(21) Appl. No.: 15/797,555

(22) Filed: Oct. 30, 2017

(65) Prior Publication Data

US 2019/0128200 A1 May 2, 2019

(51) Int. Cl.

| | |
|---|---|
| ***F02D 35/00*** | (2006.01) |
| ***F02D 41/14*** | (2006.01) |
| ***F02D 41/02*** | (2006.01) |
| ***F02D 35/02*** | (2006.01) |

(52) U.S. Cl.

CPC ..... *F02D 41/1498* (2013.01); *F02D 35/027* (2013.01); *F02D 35/028* (2013.01); *F02D 41/028* (2013.01)

(58) Field of Classification Search

CPC .... F02D 41/009; F02D 35/027; F02D 35/028; F02D 35/024; F02D 2041/281; F02D 2200/025

See application file for complete search history.

(56) References Cited

U.S. PATENT DOCUMENTS

| | | | | |
|---|---|---|---|---|
| 4,491,010 | A * | 1/1985 | Brandt | G01L 23/225 73/35.05 |
| 5,739,417 | A * | 4/1998 | Grob | F02D 35/027 73/114.07 |
| 8,468,873 | B2 * | 6/2013 | Huber | G01N 33/2829 73/35.12 |
| 9,903,307 | B2 * | 2/2018 | Polonowski | F02D 41/0245 |
| 2004/0267430 | A1 * | 12/2004 | Ancimer | F02D 35/027 701/103 |
| 2006/0106523 | A1 * | 5/2006 | Ancimer | G01L 23/225 701/111 |
| 2008/0053405 | A1 * | 3/2008 | Vigild | F02D 35/027 123/406.26 |

(Continued)

*Primary Examiner* — Thomas N Moulis
(74) *Attorney, Agent, or Firm* — Fletcher Yoder, P.C.

(57) ABSTRACT

A reciprocating engine system includes a cylinder, a piston disposed within the cylinder, a knock sensor disposed proximate to the cylinder and configured to detect vibrations of the cylinder, piston, or both, a crankshaft sensor configured to sense a crank angle of a crankshaft, and a controller communicatively coupled to the knock sensor and the crankshaft sensor. The controller is configured to receive a raw knock signal from the knock sensor and a crank angle signal from the crankshaft sensor corresponding to vibrations of the cylinder, piston, or both relative to the crank angle of the crankshaft, convert the raw knock signal into a digital value signal, and at least one of a crank angle for a start of combustion, a peak firing pressure, a percentage of fuel mass fraction burn, or a combination thereof, based on the digital value signal and the crank angle.

20 Claims, 4 Drawing Sheets

(56) References Cited

U.S. PATENT DOCUMENTS

| | | | | |
|---|---|---|---|---|
| 2008/0228447 | A1* | 9/2008 | Cordesses | F02D 35/023 702/190 |
| 2010/0286893 | A1* | 11/2010 | Huang | G01M 15/08 701/103 |
| 2011/0083642 | A1* | 4/2011 | Landsmann | F02D 35/023 123/435 |
| 2011/0168129 | A1* | 7/2011 | Kurtz | F02D 19/061 123/294 |
| 2012/0078456 | A1* | 3/2012 | Hakumura | B60L 3/003 701/22 |
| 2012/0150414 | A1* | 6/2012 | Huang | F02D 35/024 701/101 |
| 2013/0151122 | A1* | 6/2013 | Jin | F02D 41/1498 701/104 |
| 2013/0211694 | A1* | 8/2013 | Taglialatela | F02P 5/1502 701/105 |
| 2013/0246007 | A1* | 9/2013 | Oomi | G06F 3/007 702/198 |
| 2016/0245215 | A1* | 8/2016 | Bizub | F02D 41/1498 |
| 2016/0281617 | A1* | 9/2016 | Batal | F02D 35/027 |
| 2017/0003190 | A1* | 1/2017 | Nandigama | F02B 1/12 |
| 2017/0037798 | A1* | 2/2017 | Bizub | F02D 41/0052 |
| 2017/0122246 | A1* | 5/2017 | Ottikkutti | F02D 41/402 |
| 2017/0328333 | A1* | 11/2017 | Attard | F02D 35/027 |
| 2018/0372013 | A1* | 12/2018 | Turlapati | F02D 41/1452 |

* cited by examiner

ESTIMATION OF CYLINDER CONDITIONS USING A KNOCK SENSOR

BACKGROUND

The subject matter disclosed herein relates to reciprocating engines and, more specifically, to detecting changes (e.g., increases or rises) in compression ratio and peak firing pressure using a knock sensor.

Combustion engines typically combust a carbonaceous fuel, such as natural gas, gasoline, diesel, and the like, and use the corresponding expansion of high temperature and pressure gases to apply a force to certain components of the engine, e.g., piston disposed in a cylinder, to move the components over a distance. Each cylinder may include one or more valves that open and close correlative with combustion of the carbonaceous fuel. For example, an intake valve may direct an oxidizer such as air into the cylinder, which is then mixed with fuel and combusted. Combustion fluids, e.g., hot gases, may then be directed to exit the cylinder via an exhaust valve. Accordingly, the carbonaceous fuel is transformed into mechanical motion, useful in driving a load. For example, the load may be a generator that produces electric power.

In order to maximize performance, the fuel-air mixture is ignited when the piston is at a particular location in the cylinder. Unfortunately, ignition or timing of the ignition of the fuel-air mixture may become inaccurate over time. Inaccurate ignition may result in a reduction in effective expansion ratio and peak firing pressure, thereby reducing an efficiency of the engine. Alternatively, inaccurate timing of the ignition event may result in an increase in peak firing pressure resulting in other undesired conditions, such as detonation (e.g., pre-ignition, knocking, or pinging) of the fuel-air mixture in the combustion chamber, which also reduces an efficiency of the engine. Accordingly, detection of ignition accuracy in reciprocating engines is needed.

BRIEF DESCRIPTION

In a first embodiment, a reciprocating engine system includes a cylinder, a piston disposed within the cylinder, a knock sensor disposed proximate to the cylinder and configured to detect vibrations of the cylinder, piston, or both, a crankshaft sensor configured to sense a crank angle of a crankshaft, and a controller communicatively coupled to the knock sensor and the crankshaft sensor. The controller is configured to receive a raw knock signal from the knock sensor and a crank angle signal from the crankshaft sensor corresponding to vibrations of the cylinder, piston, or both relative to the crank angle of the crankshaft, convert the raw knock signal into a digital value signal, and determine at least one of a crank angle for a start of combustion, a peak firing pressure, or a percentage of fuel mass fraction burn based on the digital value signal and the crank angle.

In a second embodiment, a method includes receiving a raw knock signal from a knock sensor coupled to a reciprocating engine and a crank angle signal from a crankshaft sensor coupled to a crankshaft of the reciprocating engine, converting the raw knock signal into a digital value signal, and determining at least one of a start of combustion crank angle, a peak firing pressure, or a percentage of fuel mass fraction burn based on the digital value signal and the crank angle signal.

In a third embodiment, a system includes computer program product being embodied in a non-transitory computer readable storage medium having computer-executable instructions for receiving a raw knock signal from a knock sensor coupled to a reciprocating engine and a crank angle signal from a crankshaft sensor coupled to a crankshaft of the reciprocating engine, converting the raw knock signal into a digital value signal, and determining at least one of a start of combustion crank angle, a peak firing pressure, or a percentage of fuel mass fraction burn based on the digital value signal and the crank angle signal.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
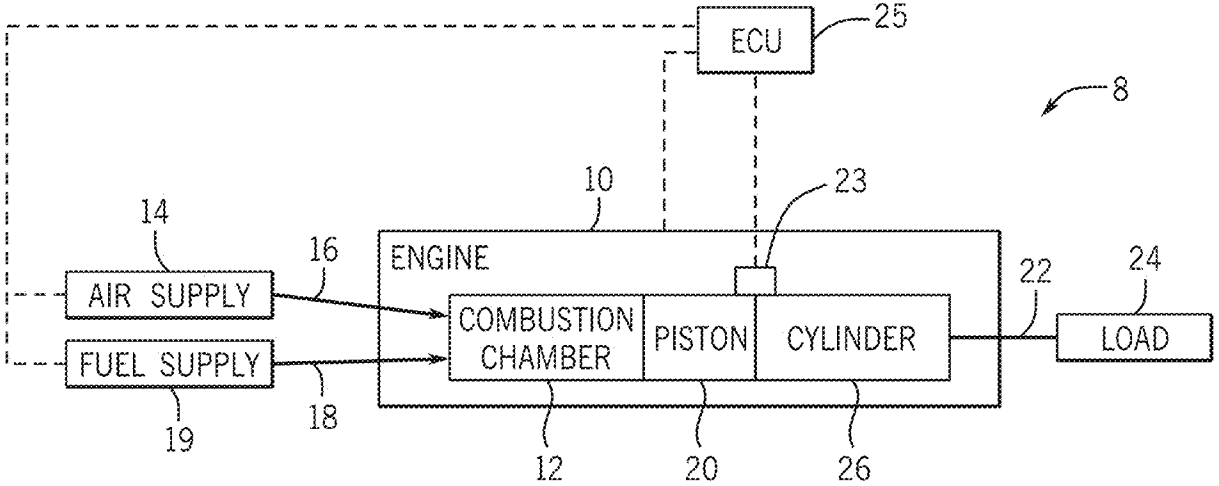
FIG. 1 is a block diagram of an embodiment of a reciprocating engine, in accordance with an aspect of the present disclosure.

One or more specific embodiments of the present invention will be described below. In an effort to provide a concise description of these embodiments, all features of an actual implementation may not be described in the specification. It should be appreciated that in the development of any such actual implementation, as in any engineering project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The present disclosure is directed to reciprocating engines and, more specifically, to detection of firing conditions with cylinders of the reciprocating engines. For example, the reciprocating engine (e.g., an internal combustion engine such as a diesel engine, gasoline engine, compressed air engine), which will be described in detail below with reference to the figures, includes a cylinder and a piston disposed within the cylinder. The reciprocating engine includes an ignition feature that ignites a fuel-oxidant (e.g., fuel-air) mixture within a combustion chamber proximate to the piston (e.g., within the cylinder and above the piston). The hot combustion gases generated from ignition of the fuel-air mixture drive the piston within the cylinder. In particular, the hot combustion gases expand and exert a pressure against the piston that linearly moves the position of the piston from a top portion to a bottom portion of the cylinder during an expansion stroke. The piston converts the pressure exerted by the hot combustion gases (and the piston's linear motion) into a rotating motion (e.g., via a connecting rod coupled to, and extending between, the piston and a crankshaft) that drives one or more loads, e.g., an electrical generator.

Generally, the reciprocating engine includes an ignition feature or mechanism (e.g., a spark plug) that ignites the fuel-air mixture within the combustion chamber as the piston moves upwardly toward the top portion of the cylinder. For example, the spark plug may ignite the fuel-air mixture when the crank angle of the crankshaft is approximately 5-35 degrees from top dead center (TDC), where TDC is a highest position of the piston within the cylinder. Timing of the ignition is important in order to maximize performance of the reciprocating engine. For example, poor timing of the ignition may cause pre-ignition (e.g., engine knocking, pinging), which describes a condition in which pockets of the fuel-air mixture combust outside an envelope of a primary combustion front. Pre-ignition may significantly reduce recovery of work (e.g., by the piston) from the expanding combustion gases and may lead to undesired maintenance events for the engine.

Thus, in accordance with the present disclosure, a knock sensor is included in, or proximate to, the cylinder of the reciprocating engine and may be communicatively coupled to an engine control unit (ECU) or controller. The knock sensor detects, e.g., vibrations of the cylinder, and the ECU or controller converts a vibrational (e.g., sound) profile of the cylinder, provided by the knock sensor, into useful parameters for determining combustion conditions in the cylinder. For example, the knock sensor detects vibrations in, or proximate to, the cylinder, and communicates a signal indicative of the vibrational profile to the ECU or controller. The controller converts the signal indicative of the vibrational profile to a parameter indicative of peak firing pressure, which describes a maximum pressure exerted by the expanding combustion gases on the piston during each expansion stroke. The parameter indicative of peak firing pressure may be a position of the piston within the cylinder (e.g., measured in crank angles at, for example, the time of ignition), a speed (e.g., maximum speed) of the piston within the cylinder, an acceleration (e.g., maximum acceleration) of the piston within the cylinder, or a pressure (e.g., maximum pressure or peak firing pressure) within the cylinder. In other words, operating or actual peak firing pressure may be determined from any one of these parameters (e.g., position, speed, acceleration, or pressure).

Generally, a baseline peak firing pressure is determined for the reciprocating engine before installation and normal operational use. The baseline peak firing pressure may be determined, e.g., in a factory before the reciprocating engine is installed for normal use. The reciprocating engine may be operated to, ideally, achieve baseline peak firing pressure during each expansion stroke. For example, an increase in operating peak firing pressure above the baseline peak firing pressure may result in engine knocking (e.g., local pockets of combustion outside the primary combustion front) that reduces an efficiency of the reciprocating engine, as the piston may be unable to efficiently recover work from the expanding combustion gases.

Accordingly, as previously described, the knock sensor transmits a signal indicative of vibration of the cylinder (or piston within the cylinder) to the controller, and the controller converts the signal into a function from which a crank angle for operating parameters such as a start of combustion, a peak firing pressure, or a percentage of fuel mass fraction burn may be determined. For example, the controller may first receive the raw signal from the knock sensor and perform filtering techniques (e.g., parametric (e.g., statistical) estimation or non-parametric estimation (e.g., neural networks and/or kernel estimation), bandpass filtering, wavelet denoising, spectral subtraction, magnitude squared coherence, cross spectral coherence, principal component analysis, independent component analysis, auto regressive and/or moving average filtering, empirical mode decomposition, total variance denoising) to achieve a filtered data signal. From the filtered data signal, the controller may determine an envelope, an energy signature, or perform other operations on the filtered data signal to develop a function that may be evaluated to determine the crank angle of the final operating parameters. From the determined crank angle, certain diagnostic functions may be performed as well. The controller may output a signal indicative of the crank angle for an operator to view. In certain embodiments, a crank angle or range of crank angles for each of the operating parameters may trigger an alarm or notification, and/or may adjust operation of the reciprocating engine. Adjustments to the reciprocating engine may include fuel injection, load, exhaust gas recirculation, firing timing, among others.

Turning to the drawings, FIG. 1 illustrates a block diagram of an embodiment of a portion of an engine driven power generation system 8. As described in detail below, the system 8 includes an engine 10 (e.g., a reciprocating internal combustion engine) having one or more combustion chambers 12 (e.g., 1, 2, 3, 4, 5, 6, 7, 8, 10, 12, 14, 16, 18, 20, or more combustion chambers 12). An air supply 14 is configured to provide a pressurized oxidant 16, such as air, oxygen, oxygen-enriched air, oxygen-reduced air, or any combination thereof, to each combustion chamber 12. The combustion chamber 12 is also configured to receive a fuel 18 (e.g., a liquid and/or gaseous fuel) from a fuel supply 19, and a fuel-air mixture ignites and combusts within each combustion chamber 12. The hot pressurized combustion gases cause a piston 20 adjacent to each combustion chamber 12 to move linearly within a cylinder 26 and convert pressure exerted by the gases into a rotating motion, which causes a shaft 22 to rotate. Further, the shaft 22 may be coupled to a load 24, which is powered via rotation of the shaft 22. For example, the load 24 may be any suitable device that may generate power via the rotational output of the system 10, such as an electrical generator. Additionally, although the following discussion refers to air as the oxidant 16, any suitable oxidant may be used with the disclosed embodiments. Similarly, the fuel 18 may be any suitable fuel, such as natural gas, associated petroleum gas, propane, hydrogen, biogas, diesel, gasoline, ethanol, sewage gas, landfill gas, coal mine gas, for example.

Determination of combustion parameters including peak cylinder pressure, start of combustion or mass fraction burn is valuable for many types of engines. Hence this methodology can be applied to many kinds of reciprocating engines including spark ignited engines, diesel engines and, dual fuel engines. Furthermore, the detection algorithms will be insensitive to the fueling strategy and engines with different fuel systems (e.g., carbureted, port injected, or direct injected) or combinations of fuel systems can implement this methodology.

The system 8 disclosed herein may be adapted for use in stationary applications (e.g., in industrial power generating engines) or in mobile applications (e.g., in cars or aircraft). The engine 10 may be a two-stroke engine, three-stroke engine, four-stroke engine, five-stroke engine, or six-stroke engine. The engine 10 may also include any number of combustion chambers 12, pistons 20, and associated cylinders (e.g., 1-24). For example, in certain embodiments, the system 8 may include a large-scale industrial reciprocating engine having 4, 6, 8, 10, 16, 24 or more pistons 20 reciprocating in cylinders. In some such cases, the cylinders and/or the pistons 20 may have a diameter of between approximately 13.5-34 centimeters (cm). In some embodiments, the cylinders and/or the pistons 20 may have a diameter of between approximately 10-40 cm, 15-25 cm, or about 15 cm. The system 10 may generate power ranging from 10 kW to 10 MW. In some embodiments, the engine 10 may operate at less than approximately 1800 revolutions per minute (RPM). In some embodiments, the engine 10 may operate at less than approximately 2000 RPM, 1900 RPM, 1700 RPM, 1600 RPM, 1500 RPM, 1400 RPM, 1300 RPM, 1200 RPM, 1000 RPM, 900 RPM, or 750 RPM. In some embodiments, the engine 10 may operate between approximately 750-2000 RPM, 900-1800 RPM, or 1000-1600 RPM. In some embodiments, the engine 10 may operate at approximately 1800 RPM, 1500 RPM, 1200 RPM, 1000 RPM, or 900 RPM. Exemplary engines 10 may include General Electric Company's Jenbacher Engines (e.g., Jenbacher Type 2, Type 3, Type 4, Type 6 or J920 FleXtra) or Waukesha Engines (e.g., Waukesha VGF, VHP, APG, 275GL), for example.

The driven power generation system 8 may include one or more knock sensors 23 suitable for detecting engine "knock." The knock sensor 23 may sense vibrations caused by the engine, such as vibration due to detonation, pre-ignition and/or pinging. The sensor may also sense vibrations caused by a "normal" combustion event. The knock sensor 23 is shown communicatively coupled to an engine control unit (ECU) 25. During operations, signals from the knock sensor 23 are communicated to the ECU 25 to determine if knocking conditions (e.g., pinging) exist. The ECU 25 may then adjust certain engine 10 parameters to ameliorate or eliminate the knocking conditions. For example, the ECU 25 may adjust ignition timing and/or adjust boost pressure to eliminate the knocking. Alternately, the ECU may adjust the parameters of the engine to either advance or retard a normal combustion event to provide more optimal efficiency or exhaust emissions. As further described herein, the knock sensor 23 may additionally derive that certain vibrations should be further analyzed and categorized to detect, for example, a start of combustion (SoC), a peak cylinder pressure (PCP), and a mass fraction burn (MFB) for the engine 10.

Figure 2:
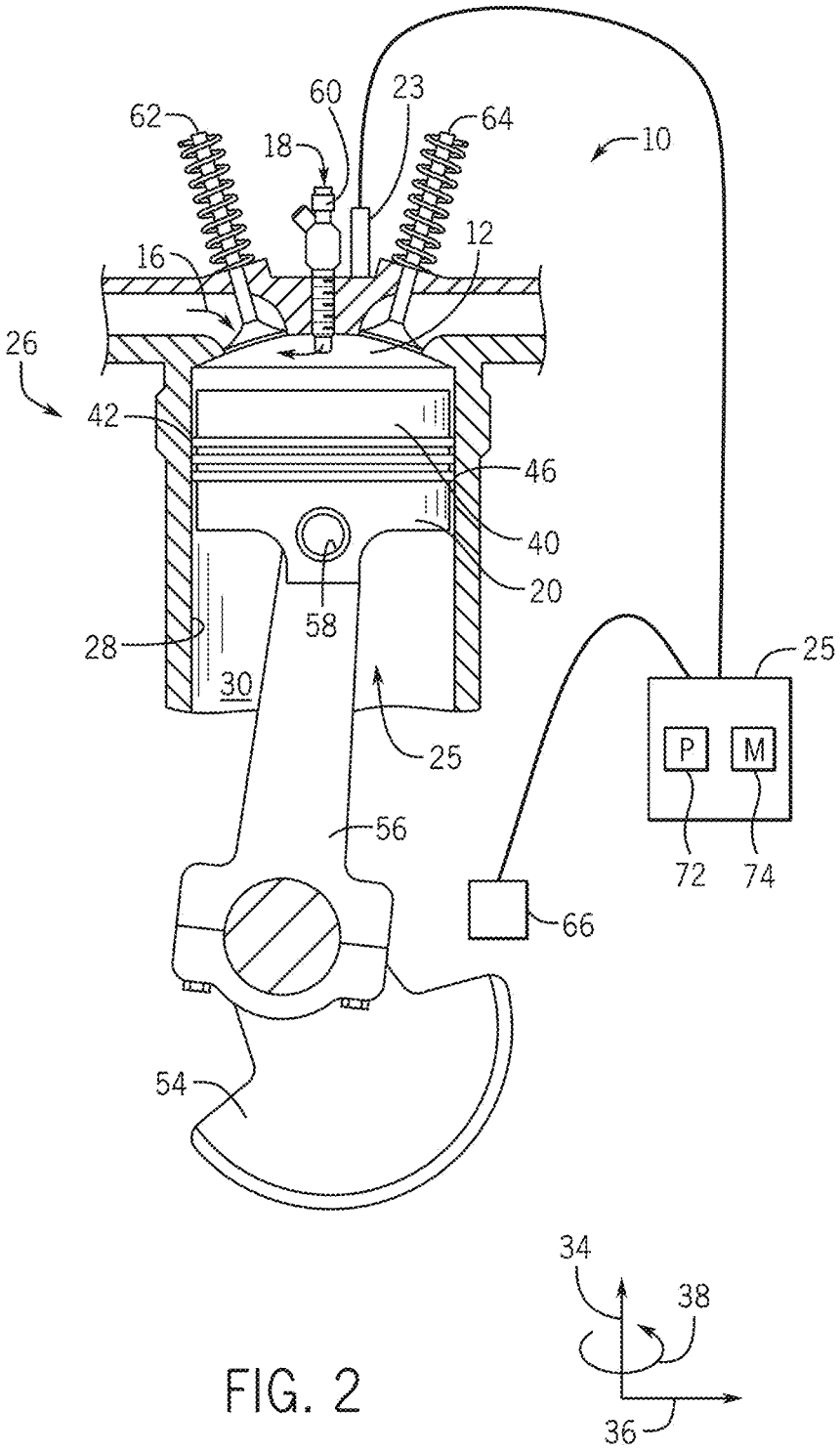
FIG. 2 is a schematic cross-sectional view of the reciprocating engine of FIG. 1 having a knock sensor, in accordance with an aspect of the present disclosure.

FIG. 2 is a side cross-sectional view of an embodiment of a piston assembly 25 having the piston 20 disposed within the cylinder 26 (e.g., an engine cylinder) of the reciprocating engine 10. The cylinder 26 has an inner annular wall 28 defining a cylindrical cavity 30 (e.g., bore). The piston 20 may be defined by an axial axis or direction 34, a radial axis or direction 36, and a circumferential axis or direction 38. The piston 20 includes a top portion 40 (e.g., a top land) and a top annular groove 42 (e.g., a top groove or a top compression ring groove) extending circumferentially (e.g., in the circumferential direction 38) about the piston 20. The top annular groove 42 may include a top ring 46 that is configured to protrude radially outward from the top groove 42 to contact the inner annular wall 28 of the cylinder 26. The top ring 46 generally blocks the fuel 18 and the air 16, or a fuel-air mixture 32, from escaping from the combustion chamber 12 and/or facilitates maintenance of suitable pressure to enable the expanding hot combustion gases to cause the reciprocating motion of the piston 20.

As shown, the piston 20 is attached to a crankshaft 54 via a connecting rod 56 and a pin 58. The crankshaft 54 translates the reciprocating linear motion of the piston 24 into a rotating motion. As the piston 20 moves, the crankshaft 54 rotates to power the load 24 (shown in FIG. 1), as discussed above. As shown, the combustion chamber 12 is positioned adjacent to the top land 40 of the piston 24. A fuel injector 60 provides the fuel 18 to the combustion chamber 12, and a valve 62 controls the delivery of air 16 to the combustion chamber 12. An exhaust valve 64 controls discharge of exhaust from the engine 10. However, it should be understood that any suitable elements and/or techniques for providing fuel 18 and air 16 to the combustion chamber 12 and/or for discharging exhaust may be utilized. In operation, combustion of the fuel 18 with the air 16 in the combustion chamber 12 cause the piston 20 to move in a reciprocating manner (e.g., back and forth) in the axial direction 34 within the cavity 30 of the cylinder 26.

The engine 10 also includes a crankshaft sensor 66, the knock sensor 23, and the ECU 25, which includes a processor 72 and memory 74. The crankshaft sensor 66 may be one or more sensors configured to sense the position of the crankshaft 54. In one embodiment, the crankshaft sensor may be a Hall effect type sensor configured to sense every 10 degrees of rotation. The crankshaft sensor 66 may be a sensor on the crank configured to detect smaller or larger intervals of rotation, for example, 1 degree, 5 degrees, 20 degrees, 30 degrees, 45 degrees, 90 degrees, 180 degrees, 360 degrees, 720 degrees, or some other intermediate interval. The crankshaft sensor 66 may also include a sensor on the camshaft configured to detect 2 revolutions of the crankshaft 54 (i.e., one complete cycle). Some embodiments may include a sensor on the crankshaft 54 as well as a sensor on the camshaft. It should be understood that these are only examples of crankshaft sensors 66 and that the crankshaft sensor 66 or sensors implemented may include one or more types of sensors not discussed.

When monitoring reciprocating engines, timing is frequently expressed in terms of crankshaft 54 angle. Thus, in the embodiment shown in FIG. 2, the crankshaft sensor 66 measures the crankshaft angle. Similarly, the knock sensor 23 is mounted on the exterior of the cylinder 26. The knock sensor 23 is typically a Piezo-electric accelerometer, but could be a microelectromechanical system (MEMS) type sensor, or another sensor designed to sense vibration, speed, acceleration, position, or movement. Because of the percussive nature of the engine 10, the knock sensor 23 is capable of detecting signatures even when mounted on the exterior of the cylinder 26. The crankshaft sensor 66, spark sensor 67, and knock sensor 23 are in electronic communication with the ECU 25. The ECU 25 monitors and controls the operation of the engine 10. The ECU 25 also receives data from the crankshaft sensor 66 and the knock sensor 23.

The knock sensor 23, in particular, may be utilized to detect vibrations associated with movement of the piston 20 within the cylinder 26. The vibration profile detected by the knock sensor 23 may be converted by the knock sensor 23 or by the ECU 25 into a parameter indicative of compression ratio or peak firing pressure. The parameter indicative of compression ratio or peak firing pressure may be analyzed by the ECU 25 via control logic implemented on the ECU to determine if the peak firing pressure has increased beyond a desirable amount, which indicates pre-ignition conditions, as explained above, or indicates the engine 10 is approaching pre-ignition conditions.

Figure 3:
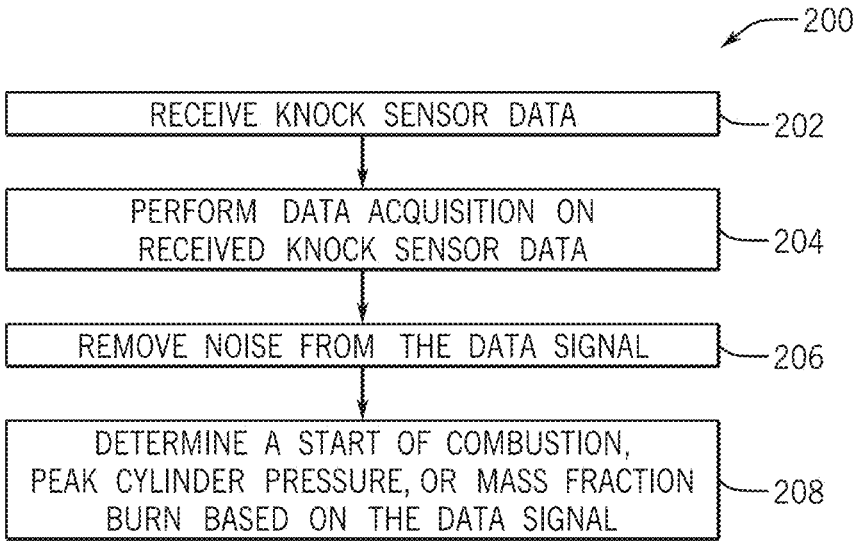
FIG. 3 is a process flow diagram of an embodiment of a method of detecting a start of combustion, peak cylinder pressure, or mass fraction burn of the reciprocating engine.

For example, a process flow diagram of an embodiment of a method 200 of detecting a start of combustion (SoC), peak firing pressure (PFP), or mass fraction burn (MFB) in the reciprocating engine 10 is shown in FIG. 3. It is to be understood that depicted embodiment of the method 200 may be executed via processors (e.g., processor 72) and may be performed in various orders of the blocks illustrated and/or with some of the blocks not performed. In the illustrated embodiment, the method 200 includes receiving knock sensor data as a data signal (block 202). As explained above, the data signal may come from the knock sensor 23 and may be an analog electrical signal that indicates the movement (e.g., vibration) of the engine 10 at the location of the knock sensor 23. The data signal may be given in terms of amplitude in relation to crank angle (e.g., as measure by the crankshaft sensor 66). The data signal is then converted to a digital knock signal by performing data acquisition on the received knock sensor data signal (block 204). The digital knock signal is now in a condition for filters or algorithms to be applied to the signal to remove noise from the data signal (block 206). The noise may be removed by bandpass filtering, wavelet denoising, spectral subtraction, or by applying other filtering techniques. The bandpass filter may include a low-pass filter, a high-pass filter, or a narrowband filter to remove data within the data signal that is not generated by combustion within the cylinder. Removing the noise from the data signal may also include envelope detection to filter oscillations from the digital knock signal. The envelope detection may include determining an upper envelope, a lower envelope, or curve detection. For example, in certain embodiments removing noise may include applying a Savitzky-Golay filter to smooth the signal. The filter may be applied alternatively or additionally to the bandpass filters, or envelope detection filters.

Once the noise has been removed from the data signal, the method includes determining conditions within the engine 10 such as: a start of combustion (SoC), a peak cylinder pressure (PCP), a fuel mass fraction burn (MFB), or any combination of these (block 208). The method may perform algorithms on the data signal for each condition separately, or may include algorithms that detect multiple conditions simultaneously.

Figure 4:
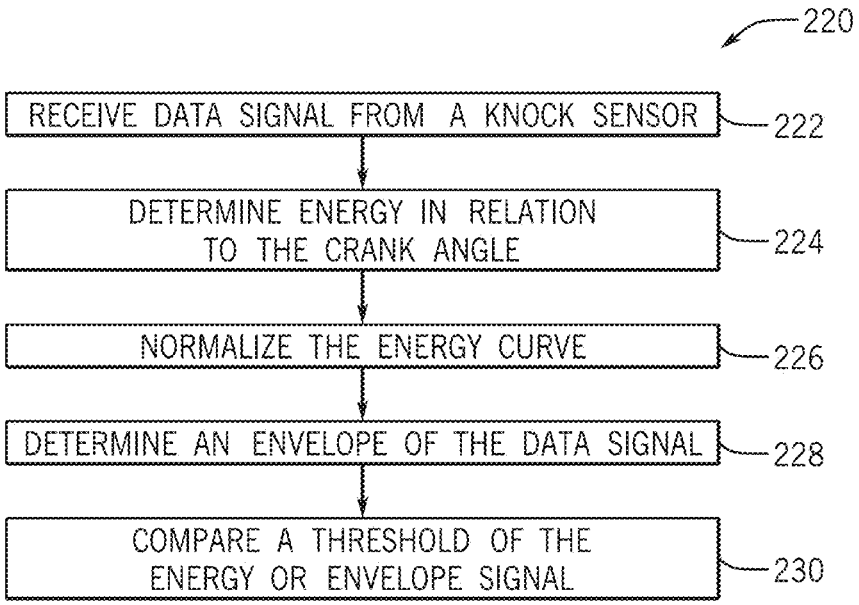
FIG. 4 is a process flow diagram of an embodiment of a method of detecting a start of combustion of the reciprocating engine.

FIG. 4 is a process flow diagram of an embodiment of a method 220 of detecting a SoC of the reciprocating engine 10. The method 220 may be performed additionally or alternatively to the method 200 described above. It is to be understood that depicted embodiment of the method 220 may be executed via processors (e.g., processor 72) and may be performed in various orders of the blocks illustrated and/or with some of the blocks not performed. The method 220 includes receiving a data signal from a knock sensor 23 (block 222). The data signal may be adjusted as described above to remove noise so that a more accurate crank angle location may be determined for the SoC. As described above, the data signal may be received and/or filtered by the ECU 25. After receiving the data signal, the method 220 includes determining energy in relation to the crank angle (block 224). The energy may be determined by taking the integral of the data signal, taking the integral of the data signal squared, taking the integral of a filtered data signal (high-pass filter, low-pass filter, narrowband pass filter, and/or combination of filters), or any combination thereof. The energy determined in the method 220 may be normalized to a consistent max value for a given cycle of the engine 10 (block 226).

Additionally or alternatively to determining the energy of the data signal, the SoC may be determined by involving the determination of an envelope of the data signal (block 228). Calculating or determining the envelope may be done using an upper envelope, a lower envelope, or curve detection techniques. The envelope is a curve that represents a distilling of the data signal that may be read by the ECU 25. The envelope of the data signal, the energy of the data signal, or combination thereof may be compared to a threshold to determine the SoC. The threshold, for example, may be between 1 percent and 10 percent of the normalized value of the energy or envelope, or may be between 2 percent and 7 percent, or may be 5 percent of the normalized values. The ECU 25 may thus determine that combustion has started when the threshold is reached. The threshold may be obtained through testing the combustion chamber 12 under laboratory conditions. That is, in a laboratory, extra sensors may be included within the combustion chamber 12 to determine exactly when combustion starts, and the actual SoC may be compared to the SoC determined by the ECU 25 using the data signal from the knock sensor 23.

Figure 5:
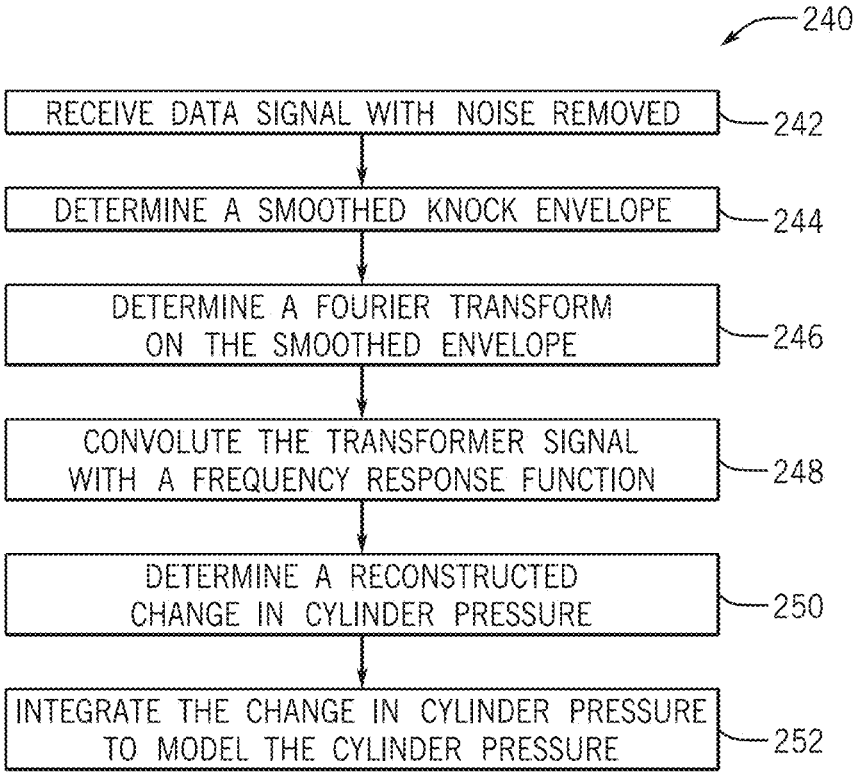
FIG. 5 is a process flow diagram of an embodiment of a method of detecting a peak firing pressure of the reciprocating engine.

FIG. 5 is a process flow diagram of an embodiment of a method 240 of detecting a PFP of the reciprocating engine 10. It is to be understood that depicted embodiment of the method 240 may be executed via processors (e.g., processor 72) and may be performed in various orders of the blocks illustrated and/or with some of the blocks not performed. The method 240 starts with receiving the data signal with the noise removed (block 242). The method 240 then involves determining a smoothed knock envelope (block 244). The smoothed knock envelope may be determined similarly to the envelopes for SoC. The smoothed knock envelope is then transformed through a Fourier transform (block 246). After transforming, the knock envelope transform is convolved with an inverse frequency response function (block 248). The frequency response function is determined through testing of the engine, or similar model engines, in which the actual cylinder pressure may be measured. Under such tests, the frequency response function may be determined by measuring the knock signal response, given by the envelope from the knock sensor data signal, due to a stimulus, given by a smoothed function of the change in actual cylinder pressure. The frequency response function may begin as an estimated transfer function which is then averaged over many cycles until the frequency response function achieves the appropriate degree of accuracy. The testing cycles may be completed under varying engine conditions (e.g., throttle or notch, temperature, humidity, fuel composition) so that the frequency response function remains accurate for substantially all of the conditions in which the engine 10 may operate. Alternatively, multiple frequency response functions may be determined, such that all the frequency response functions taken together cover all of the conditions in which the engine 10 may operate.

After the data signal is convolved, the method 240 includes determining a reconstructed change in cylinder pressure (block 250). The change in cylinder pressure may be reconstructed by taking the inverse Fourier transform. The change may be integrated to model the actual cylinder pressure (block 252). The PCP is the crank angle at which the maximum value of the reconstructed cylinder pressure is located.

Figure 6:
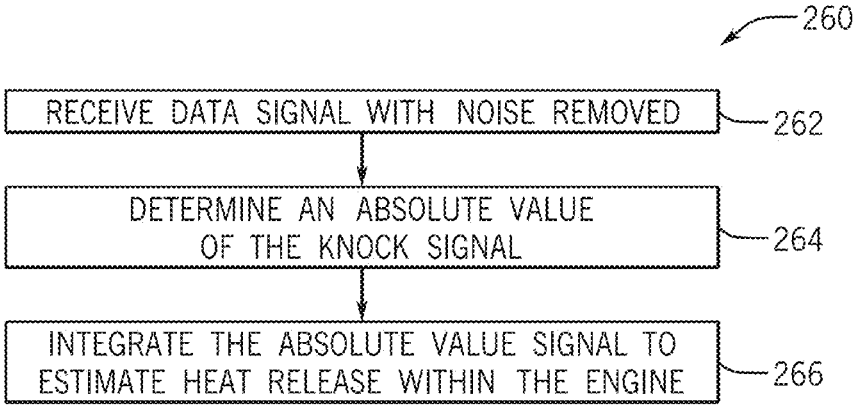
FIG. 6 is a process flow diagram of an embodiment of a method of detecting a mass fraction burn of the reciprocating engine.

FIG. 6 is a process flow diagram of an embodiment of a method 260 of detecting a mass fraction burn of the reciprocating engine 10. It is to be understood that depicted embodiment of the method 260 may be executed via processors (e.g., processor 72) and may be performed in various orders of the blocks illustrated and/or with some of the blocks not performed. It is useful to know the crank angles at which different amounts of fuel has been burned. For example, knowing the crank angles for when 10 percent, 25 percent, 50 percent, 75 percent, and/or 90 percent of the fuel has been burned can provide information to correct fuel ratios, improve exhaust proportions, or diagnose incorrect combustion within a given combustion chamber 12. In certain embodiments, it is possible to measure the change in heat to determine the percentage of MFB. These techniques, however, use sensors that may be expensive and/or located in difficult-to-reach places within the engine 10. Thus, accurately measuring the MFB with the knock sensor 23 can be very valuable. The method 260 begins with receiving the data signal with the noise removed (block 262). The noise may be removed, for example, by filtering, as described above. The method then includes determining an absolute value of the knock signal (block 264) and integrating the absolute value (block 266). The method 260 may be repeated over a plurality of cycles to bolster the resulting estimate for MFB. The individual results from each cycle may be normalized so that each estimate for each cycle has a maximum value of "1". The resulting function, or combined function, reflects the heat transfer well enough that a crank angle of predicted MFB can be accurate to within a range of ±3, 4, or 5 degrees from the actual MFB. So the crank angle that matches the point on the function for a specific percentage of the maximum value is an accurate estimate of the crank angle at which the actual MFB occurred for that percentage.

Once the parameters have been inferred (e.g., start of combustion (SoC), peak cylinder pressure (PCP), fuel mass fraction burn (MFB), or any combination of these, the ECU may command a change a controlled engine parameter including but not limited to: injection timing, injected fuel quantity, engine speed, air-fuel ratio, spark timing, or fuel pressure.

In general, systems and methods in accordance with the present disclosure detect operating conditions within a reciprocating engine 10 based on signals from a knock sensor 23. The systems and methods utilize detection of vibrations of a cylinder 26 of the engine 10 or of a piston 20 with the cylinder 26, conversion of the vibration profiles to one or more values can accurately predict or model a start of combustion, a peak firing pressure, and/or a fuel mass fraction burn. By implementing various control logic on a controller (e.g., engine control unit (ECU 25)) and utilizing the control logic to compare the various values detected by the knock sensor, operating data and potential problems can be communicated to an operator, such that the operator may intervene and remedy the problem.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A reciprocating engine system, comprising:
- a cylinder;
- a piston disposed within the cylinder;
- a knock sensor disposed proximate to the cylinder and configured to detect vibrations of the cylinder, piston, or both;
- a crankshaft sensor configured to sense a crank angle of a crankshaft; and
- an engine control unit (ECU) communicatively coupled to the knock sensor and the crankshaft sensor, the ECU configured to:
  - receive a raw knock signal from the knock sensor and a crank angle signal from the crankshaft sensor corresponding to vibrations of the cylinder, pistion, or both relative to the crank angle of the crankshaft;
  - convert the raw knock signal into a digital value signal;
  - apply a denoising algorith to the digital value signal to determine a denoised data signal; and
  - determine a crank angle for a start of combustion, a peak firing pressure, a percentage of fuel mass fraction burn, or a combination thereof, based on the denoised data signal and the crank angle.

2. The system of claim 1, wherein the controller is configured to determine the crank angle for the start of combustion by determining an energy associated with the denoised data signal.

3. The system of claim 2, wherein the controller is configured to determine the crank angle for the start of combustion by comparing the energy associated with the denoised signal to a threshold value.

4. The system of claim 3, wherein the threshold value comprises 5 percent of a maximum value of the energy associated with the denoised signal.

5. The system of claim 1, wherein the ECU is configured to determine the crank angle for the start of combustion by determining an envelope of the data signal.

6. The system of claim 5, wherein the ECU is configured to determine the crank angle for the start of combustion by comparing the envelope to a threshold value.

7. The system of claim 6, wherein the threshold value comprises 5 percent of a maximum value of the energy associated with the denoised signal.

8. The system of claim 1, wherein the ECU is configured to output a notification of the determined crank angle for the start of combustion, the peak firing pressure, the percentage of fuel mass fraction burn, or a combination thereof.

9. A method, comprising:
- receiving a raw knock signal from a knock sensor coupled to a reciprocating engine and a crank angle signal from a crankshaft sensor coupled to a crankshaft of the reciprocating engine;
- converting the raw knock signal into a digital value signal;
- applying a denoising algorithm to the digital value signal to determine a denoised data signal; and
- determining a start of combustion crank angle, a peak firing pressure, or a percentage of fuel mass fraction burn based on the denoised data signal and the crank angle signal.

10. The method of claim 9, wherein determining the peak firing pressure comprises deriving a smoothed knock envelope of the denoised data signal.

11. The method of claim 10, comprising deriving a Fourier transform of the smoothed knock envelope.

12. The method of claim 11, comprising convoluting the Fourier transform with a frequency response function.

13. The method of claim 12, wherein the frequency response function is derived by testing a cylinder pressure derivative under known conditions.

14. The method of claim 9, wherein determining the fuel mass fraction burn comprises determining an absolute value of the denoised data signal and integrating the absolute value.

15. The method of claim 14, wherein determining the fuel mass fraction burn comprises normalizing a plurality of integrated absolute values from a plurality of engine cycles.

16. A computer program product being embodied in a non-transitory computer readable storage medium and comprising computer-executable instructions for:

receiving a raw knock signal from a knock sensor coupled to a reciprocating engine and a crank angle signal from a crankshaft sensor coupled to a crankshaft of the reciprocating engine;

converting the raw knock signal into a digital value signal;

applying a denoising algorithm to the digital value signal to determine a denoised data signal; and determining a start of combustion crank angle, a peak firing pressure, or a percentage of fuel mass fraction burn based on the denoised data signal and the crank angle signal.

17. The computer program product of claim 16, wherein a frequency response function is used for determining the peak firing pressure.

18. The computer program product of claim 16, comprising adjusting engine operations based on the combustion crank angle, the peak firing pressure, or the percentage of fuel mass fraction burn.

19. The computer program product of claim 16, comprising raising an alarm or an alert based on on the combustion crank angle, the peak firing pressure, or the percentage of fuel mass fraction burn.

20. The computer program product of claim 16, wherein the controller is configured to receive a plurality of knock signals from a plurality of knock sensors to determine a start of combustion, a peak firing pressure, or a percentage of fuel mass fraction burn for a plurality of cylinders within the reciprocating engine.

* * * * *